US005152526A

United States Patent [19]

Soong

[11] Patent Number: 5,152,526

[45] Date of Patent: Oct. 6, 1992

[54] FRAME FOR SPORTS RACKETS

[76] Inventor: Tsai C. Soong, 1839 Jackson Rd., Penfield, N.Y. 14526

[21] Appl. No.: 503,865

[22] Filed: Apr. 3, 1990

[51] Int. Cl.[5] ..... A63B 49/02

[52] U.S. Cl. ..... 273/73 C; 273/73 R; 273/73 D

[58] Field of Search ..... 273/73 R, 73 C, 73 E, 273/73 F, 73 G, 73 H, 73 J, 73 K, 73 L

[56] References Cited

U.S. PATENT DOCUMENTS

| | | | |
|---|---|---|---|
| Re. 31,419 | 10/1983 | Frolow | 273/73 C |
| 4,365,806 | 12/1982 | Reid | 273/73 C |
| 4,836,543 | 6/1989 | Holzer | 273/73 C |

FOREIGN PATENT DOCUMENTS

| | | | |
|---|---|---|---|
| 2581317 | 11/1986 | France | 273/73 L |

OTHER PUBLICATIONS

European Patent Application, Tsai Chen Soong, Frame for Sports Racket, Sep. 27, 1983 (Filing date).

*Primary Examiner*—William H. Grieb

*Assistant Examiner*—Raleigh W. Chiu

*Attorney, Agent, or Firm*—Bernard A. Chiama

[57] ABSTRACT

A frame is disclosed for use as a sports racket, the frame being closed to surround and support a string network comprising longitudinal and cross strings to define a ball hitting region. The midplane of the frame or that plane which extends through the center thereof whereby one closed side of the frame is symmetrical with the other closed side is in coincidence with the plane of the string network as is typical with sports rackets. The frame structure is formed by an outer wall and an inner wall spaced inwardly from the outer wall toward the string network, with both walls being perpendicular to the midplane of the frame. A multiplicity of plate-like panels arranged perpendicular to the midplane of the frame are connected to and between the walls to provide a unified frame structure. The panels are spaced from each other and the walls to define open spaces which extend through the frame from one side thereof to the other and without obstruction therein. The width of the walls may be of different dimensions and the angular orientation of the panels relative to the walls may assume different values.

6 Claims, 3 Drawing Sheets

FRAME FOR SPORTS RACKETS

INVENTION BACKGROUND

In sports racktet frame, such as tennis racket, the design goal is to have the highest in strength to weight ratio, and the lowest in cost. Materials have been changed from wood to metal and progressed to fiber reinforced plastics, with sizes from small to large to medium plus heads, which all contribute to better rackets. But the cost of production remains high due to the complicated process of modern fiber reinforced composite technology. The frame of a fiber reinforced racket is usually of a hollow, thin-walled cross section with a large number of fiber/thermoplastic layers piled one layer over the other at different fiber orientation angles for optimum strength. The steps of cutting multilayered cloth, folding the same over thermo-expandable core or air tube, laying into the mold, heat treating, polishing and adding cosmetics, are all very time-consuming and labor intensive. Hence the high production cost of modern fiber-reinforced rackets.

The main difficulty in racket frame design technology is the extreme high ratio of the strength to weight required. This explains why people in the trade maintain the existing practice and refuse to acknowledge new approaches. For example, the weight of a tennis racket is from 335 gm to 370 gm, with about 350 grams, preferred by most players, as nominal. Within the 350 grams, bumper guard plus the grommet strips take 22 gm, handle foams 27 gm, leather grip 17 gm, end cap 10 gm, string 21 gm, and polishing plaster and paint 19 gm, with the composite frame extending from the head to the end being about 232 gm. The mass allocated to form the portion of the frame to support the string network from the head of the racket to the throat, measured about 80 cm in circumference, is about 100 gm. To apportion more material from the rear part of the frame to the ball-playing area will make the tennis racket too head-heavy for most players. The 100 grams distributed to a length of 80 cm is approximately 1.25 gm per centimeter (0.11 oz per inch). If the material is 100% graphite/epoxy which has a specific gravity of 1.35, the 1.25 gm/cm will yield an average volume density of 0.90 c.c. volume for each centimeter of the circumference along the ball-hitting region. This is the goal of frame design.

However, for that allocated little mass per unit length, a great deal of load-carrying capacity is expected. Each string is pre-stressed at over 65 pounds of force. At a circumference of 80 centimeters, excluding the throat length, there are 16 such highly loaded longitudinal strings and 20 cross strings. The cross section of the frame should be strong enough to serve the tennis ball at a speed over 120 miles per hour for many hours of play without failure. Even the aluminum alloy is presently thought of as too heavy to achieve the desired weight distribution (Volume density) at the head.

A high performance racket with composite material may achieve the design goal but the frame should vary optimally in height and width along the periphery of the network area, along the throat, the shank, and into the handle. An optimum design for fiber reinforced frame has to have the necessary dimension at a particular location to resist the load. It needs an average bending moment of inertia ($I_x$) of about 0.28 $cm^4$ with respect to the x-axis, parallel to the string network plane, to resist the ball force, and a bending moment of inertia ($I_y$) of about 0.08 $cm^4$ with respect to the y-axis, perpendicular to the string network plane, to resist the stringing load. A sufficient polar moment of inertia for the cross section is also required. Consequently, a labor intensive molding method is best suited for fabricating the modern fiber-reinforced tennis rackets, because it can be manipulated in width and in height, and in varying numbers of layers and in reinforcing patches, to achieve the maximum strength with minimum weight. This is the main reason that people in the trade never have given serious thoughts to consider other fabrication methods, and other frame shapes than the time tested thin-walled, hollow frame. These professionals have been constantly exposed to other feasible production processes in other industries and in other products. Most of the innovative ideas published are not practical to meet the rigorous strength to weight requirement and they all are inferior to the graphite thin walled hollow frame. A new invention to suggest a different frame should pass the criteria that it can have, or even better, the required sectional properties listed before as achieved by prior art and show it can be superior in simplicity and in cost.

INVENTION

The invention suggests that the frame is designed to be able to be extruded, or injection molded, or formed by other suitable methods, with the outer wall and the inner wall of the frame rigidly connected to each other by a system of, thin-walled panels of the same material characterized in that each panel is perpendicular to the plane of the string network and are arranged relative to each other to provide large openings between the panels extending from one end to the other. In its simplest arrangement, each panel connects the outer wall to the inner wall and is not intercepting other panels. Panels can also link to each other as well as with the walls like an honeycomb sandwich with the cover plates removed. Said openings made among panels and the walls may be in the form of polygons. Details are described in later sections.

DRAWINGS

DESCRIPTION

Figure 1A:
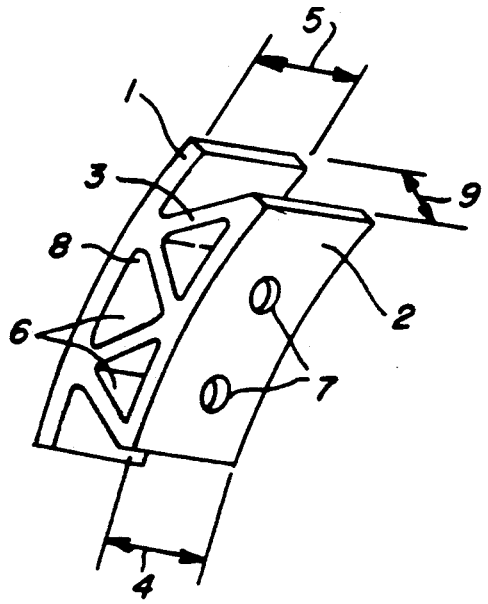
FIGS. 1A and 1B shows a segment of a frame of the invention design.
Figure 5:
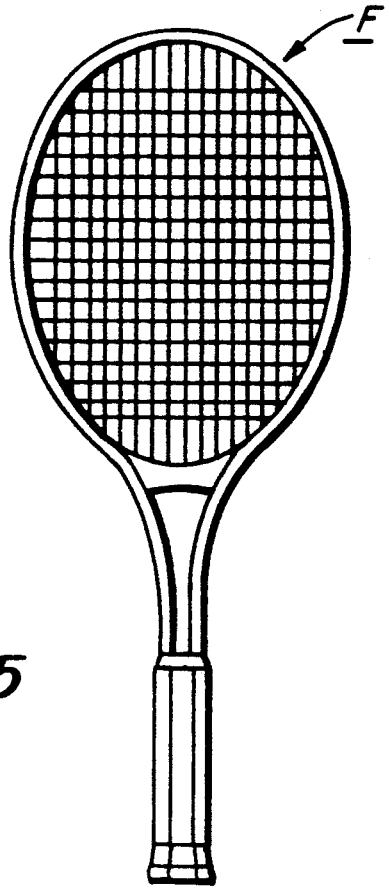
FIG. 5 shows a sports racket which may incorporate the present invention.

FIG. 1A shows a typical portion of a desired frame of generally circular form as in the conventional tennis racket and conforming to the intent of the invention. The frame as designated by the letter F in FIG. 5, section is symmetric to the midplane of the frame which is the same plane of the string network. Outer wall 1 forms the outer boundary of the frame, inner wall 2 forms the inner boundary of the frame, and multiple panels 3 which connect the two walls are all, perpendicular to the midplane and have large openings as shown.

The inner wall height 4 is the desired nominal frame thickness perpendicular to the plane of the string network. The outer wall 1 with height 5 may have the same height as the inner wall, or may be machined later to reduce height if desired or may be, molded with the desired height without later machining. The height of the panels 3 may similarly be reduced. Openings 6 between the panels and the walls may be triangular, rectangular or of other polygon shapes. String holes 7 may be made in outer and inner walls, and in panels if needed, to pass strings. Sufficient amounts of the panel/wall material to form fillets may be molded along with the connections of the panels to the walls. Distance between the two walls 9 may be varied along the length of the circumference of the frame.

Figure 1B:
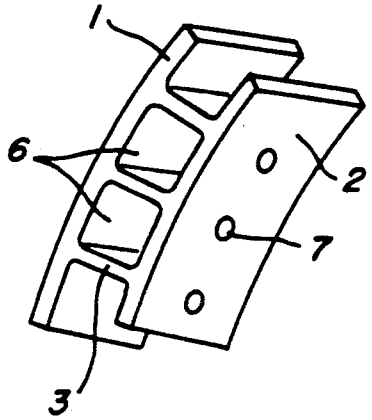

FIG. 1B shows the same frame as 1A except the panels are approximately perpendicular to the walls and are not interconnected to each other. Holes 7 may be passed through the interior of the panels so as not to expose the strings. This will reduce air resistance caused by the portions of the strings between the inner and outer walls. Frames as in FIG. 1A and 1B are preferred when all structural regions of the entire frame from the head to the core of the handle are of the similar design intent and the entire frame can be made by extrusion as a single piece.

Figure 2:
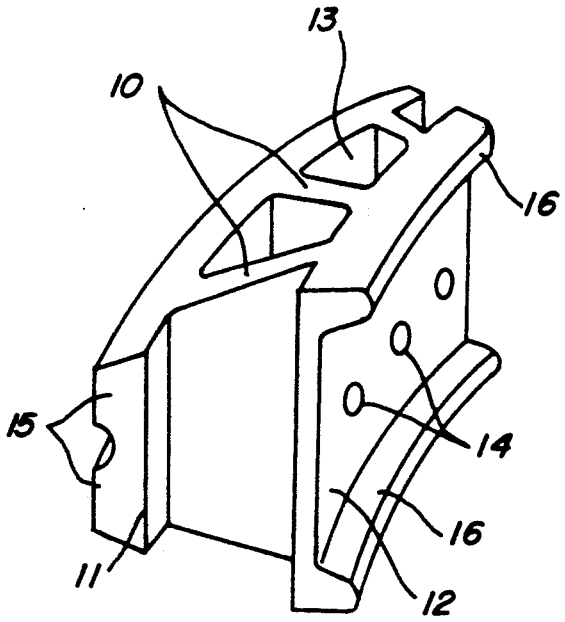
FIG. 2 shows a different frame of the invention design.

FIG. 2 shows another preferred frame shape. Panels 10 connect inner and outer walls 11 and 12 and openings 13 may be of the shape of any polygon. Here, the walls 11 and 12, which define the spaces 13 therebetween, are not of constant thickness along the direction perpendicular to the midplane. Inner wall 12 preferred to be the primary structural element for carrying the bending load induced upon a frame by the impact of a ball, and which is shaped like a flanged channel as shown in FIG. 2. The outer wall 11 only provides string support, for passing strings and for providing rigidity in resisting the stringing load and the torsional load from the impact of a ball. Molding methods, including injection molding in particular, are best suited to make this type of frame.

FIG. 1 and FIG. 2 contain all the characteristics of the invention:

1. The frame has a distinct outer wall and an inner wall which are kept at a distance apart;

2. Multiple parallel thin-walled, straight panels are the structural elements that connect the outer wall to the inner wall;

3. Parallel openings, in the form of triangle, rectangle, and other polygons, are formed between panels and the walls, as they extend from one end to the other;

4. Said parallel panels are continuous, thin-walled plate-like structural elements; and 5. Said parallel panels connect the outer wall to the inner wall in a repeated geometric pattern along the circumferential direction of the frame.

Furthermore, when the invention is looked upon as a new innovative design concept for a racket frame to carry the string and distribute its load, it may be characterized by:

6. A continuous structural l-beam, channel (12 in FIG. 2) or other sections, constitutes the major structural member of the frame wherein a system of multiple thin-plates (11) perpendicular to the midplane of the frame, join the major structural member at one end, extend outward and support individually a bar-like, overhang continuous member (11), which carries the string, passes it through the holes 14, and guides it towards the string network.

The distinction between the invention and the conventional way of supporting the string at the frame is as follows. In all sports rackets, the part of the frame structure that physically supports and carries the string has always been a continuous, physically solid and non-discrete part of the frame. This observation is true by looking at a thin-walled hollow frame where the string runs along the outer wall and goes through the frame by holes drilled perpendicular to the outer and the inner walls of the frame to reach the interior of the network. This is also true when considering solid frames. In all these instances, the string supporting surface has always been an integral, continuous, non-discrete part of the frame. It comes naturally in design and there is no reason for ordinary designer to deviate from this design practice. The present new way to support the string-carrying wall 11, which has a width more narrow than the wall 12, is by overhanging brackets 15, away from the major structural member 12 is entirely a different matter, as will be discussed below.

Viewing the frame of FIG. 1 from the top side, the frame looks like an honeycomb sandwich plate with its face plates removed. In that way, the sandwich core is the parallel panels which are bounded by the outer wall 1 and the inner wall 2. Such structural elements may be applied to throat, shank and for the structural core of the handle of the frame. Walls 1 and 2 may be straight or curved, and the distance 9 may be varied according to the loads and the geometry at that particular location of the frame. The fact that these walls and the panels remain perpendicular to the midplane, and of constant thickness, suggests that the entire frame, including head, throat, shank and the core of the handle, may be made in a single integrated piece by extrusion, or similar processes which force material through a die to form a continuous structure. After a piece is cut from the extrusion, it is a completed frame except to add the head bumper, grommet strips, handle foam, grip and cosmetics. This idea of extrusion to make a completed raw frame in a single stroke, is a revolutionary concept which is possible only when the frame section as shown in FIG. 1A and 1B is used. Obviously, the cost of fabrication will be very low. There is no need for mechanical connections whatsoever. A raw frame cut off from the extrusion is almost 90% complete, which saves greatly the time and fabrication cost. It is estimated that comparison of frame to frame of making fiber-reinforced tennis racket frame, the cost is about 1:6 in ratio to favor the extrusion.

In FIG. 2, it will be noted that the outer wall 11 and inner wall 12 are not constant in thickness along the direction perpendicular to the midplane. Inner wall 12 may take the form of an l-beam or channel with flanges wide apart. The overhanging outer wall 11 is used to support the string and is dimensionally much smaller. The multiple panels 10 are supporting wall 11 like brackets by means of wall 12. Openings 13 formed by inner surfaces of these structural members joined together are unobstructed from one side of the frame structure to the other. This suggests that a conventional molding process, particularly the injection molding, may be used to advantage.

It is to be noted that the modern hollow thin-walled tubular frame for which the inner wall is connected to the outer wall by upper and lower surfaces, leaving the interior characteristically hollow without access from outside, makes injection molding method almost impossible without expensive and complicated processes. One example is by using a premade low-melting metal core in the form of the hollow interior of the frame which is imbedded and supported against movement inside the mold before the frame molding is made. After the frame molding is made, with the core remaining inside, the molding is heated again to a temperature not high enough to damage the frame but high enough to melt and get rid of the core. This technique is not inexpensive, but it is the only prior art method to make a hollow composite racket frame. In the invention proposed, there is no such inaccessible hollowed interior. Frame walls 11 and 12 are parallel to each other and are connected by panels 3 whose cavities are easily accessible from one side of the frame structure to the other. A conventional injection molding method can be used without any technical complication. As will be described below the frame produced by this method is even stronger than the hollow thin-walled shell frame of equal weight per unit length.

Figure 3A:
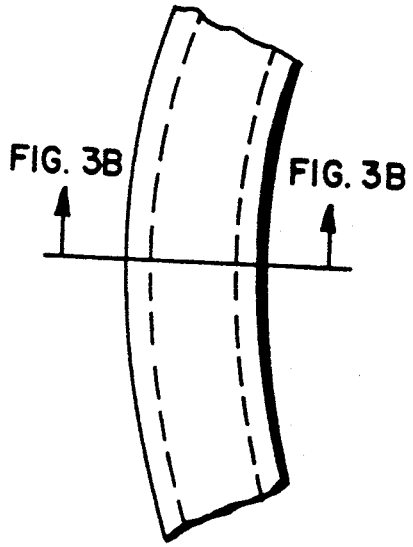
PRIOR ART FIG. 3A
FIG. 3A shows a section of one of the best fiber-reinforced hollow frames in the prior art.
Figure 3B:
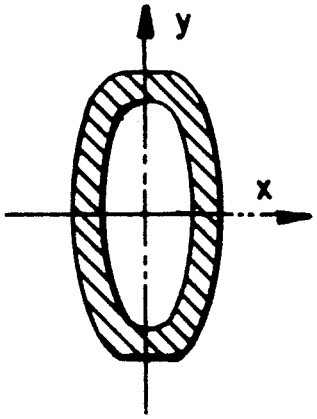
PRIOR ART FIG. 3B
FIG. 3B is a cross-sectional view taken along the line 3B—3B in FIG. 3A.
Figure 4A:
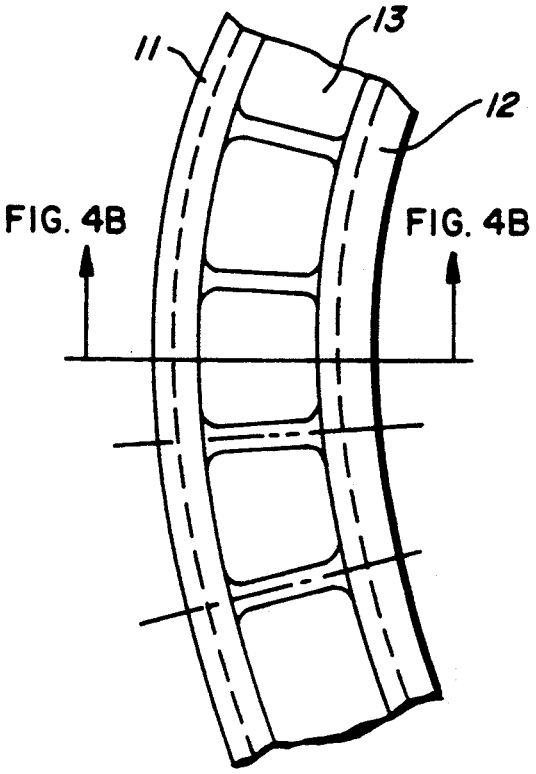
FIG. 4 shows the dimension of an invention design which has the same volume density as that in FIG. 3.
Figure 4B:
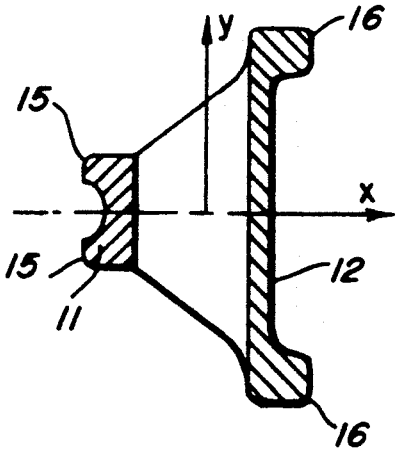

As an example for comparison. FIGS. 3A and 3B show one of the best hollow graphite frame currently in use in a tennis racket sold under the trademark "SP.IN" owned by the Special Innovations Company as their model G300. This tennis racket won the top rating, with three perfect scores in power, control, etc. among 52 leading tennis rackets in a play test competition conducted by the Lawn Tennis Association (LTA) of England, and reported in its official magazine SERVE & VOLLEY, April 1988 issue. The graphite-fiber frame has 100 square inch playing area, and weight of 350 gm in weight. The cross section of the frame is shown in FIG. 3B. The frame by the invention is shown in FIGS. 4A and 4B. They both are 0.90 c.c. per 1 cm frame length, 1.22 gm per cm in linear density. A finite element structural analysis has been done to study the frame's strength. The important fact to be noted here is that the frame of FIGS. 4A and 4B is 32% stronger in bending moment of inertia ($I_x$) against the ball load, and 118% stronger in bending moment of inertia ($I_y$) against the stringing load, than the FIG. 3A and 3B hollow frame of the "SP.IN" G300 tennis racket. Incidentally, the moment of inertia of these sections an be easily checked by elementary formulas without elaborate computers.

The reason that the section of FIGS. 4A and 4B is stronger than FIGS. 3A and 3B along both axes is because the channel has flanges 16 which are at a large distance apart (25 mm) and the width between the two walls is greater (15 mm against the 10 mm). As a rule, designers tend to shy away from having structural materials spent near the neutral axes (midplane of the frame) of the cross section of a frame, because in theory material near the midplane does not add to the bending strength of the section. While a hollow shell is an efficient structure, it has escaped trade peoples' observation that the brackets supporting the overhanging outboard member had actually increased the frame's bending rigidity against the stringing load due to the rigidity offered by the panel brackets against compression in the radial direction. A thin shell developing wrinkles at the compressed side is because the inner and outer walls tend to move towards each other during bending. The brackets 16, which are outwardly extending projections formed on the panels 3 and 10, as shown in FIGS. 2 and 4, prevent this kind of movement in the invention frame. It should also be pointed out about the improvement of the torsional rigidity of the channel. Since the outer member 11 can not elongate freely due to the constraint imposed by the overhanging brackets, the channel has less freedom to twist. All these can be shown in finite element analysis. These merits will offset the disadvantage of having material near the neutral axis. Finally, the deciding merit is the tremendous benefit of making it possible to use the regular injection molding method to fabricate the FIGS. 4A and 4B frame avoid the use of the special fusible core method that is expensive and time-consuming.

From the point of view of how the string is supported, FIGS. 4A and 4B show clearly how the string-carrying, bar-like outer wall is supported periodically by thin, plate-like, panels extending outwardly from the channel. In this way, the major portion of the mass of the frame is being used effectively as a structural channel which may have flanges far apart, as shown in the 25 mm height between the flanges, not attainable by a hollow shell as shown in FIGS. 3A and 3B. Also the design enables the minor outer member 11 whose main function is to carry the string to be kept at a considerable distance apart from the channel to contribute more to the inplane bending rigidity of the assembly in spite of its small mass. This is an innovative way to carry the string in sports racket which is superior to prior art.

FIGS. 4A and 4B show only one of the ways a design can be made according to the present application. With a distance between the two walls not too large, panels 10 in FIG. 2 may just be perpendicular to the respective walls 11 and 2 and not connected to each other. In that case, strings may pass through the interior of the panels and need not be exposed in openings 13. When frames as shown in FIG. 2 are made by molding, panels 10 can have variable thickness, or have openings formed therein to lessen the weight, and the web in the channel may have openings besides the stringing holes. This will allow material in the web to be used somewhere else to improve the strength of the assembly. If the string is not inside the panel from the outer wall to the inner wall, the hole in the inner wall may be bigger than the size of the string. This will allow the string network to have an effective vibration area larger than the inner boundary of the frame.

What is claimed is:

1. A sports racket having a curved closed frame supporting a string network wherein a major portion of the frame supports the string network and is symmetrical relative to the plane of the string network, comprising an outer wall perpendicular to the midplane of the frame, an inner wall parallel to said outer wall and being spaced inwardly thereof toward the string network, said walls being defined by side edges coinciding with the sides of the frame defining the width of the frame in the plane of the string network and being separated by and connected with each other by a multiple system of panel members arranged perpendicular to the midplane of the frame and extending from one side edge of said walls to the other side edge thereof, said panel member defining large open spaces between themselves and said walls which extend through the height of the frame without obstruction.

2. The sports racket of claim 1 wherein the open spaces between the panels and between panels and the walls are of triangular shape or rectangular shape.

3. The sports racket of claim 1 wherein the open spaces between the panels and between panels and the walls are of a polygon shape other than triangle and rectangle.

4. The sports racket of claim 1 wherein the majority of strings pass through the space between the outer wall and the inner wall are through the interior of said panels.

5. In a sports racket having a curved frame supporting a string network wherein a major portion of the frame is symmetrical relative to the plane of the string network, comprising an inner wall having a channel-shape cross-section, an outer wall of the frame having a wall height less than the wall height of said inner, wall, multiple plate members arranged perpendicular to and symmetrical relative to the plane of the string network and connecting said outer wall to said inner wall, said plate members defining large open spaces between themselves and said walls which extend through the height of the frame without obstruction.

6. The sports racket of claim 5 wherein the majority of strings passing through the region between said inner and outer walls are through holes made in the said plate members without being exposed in said openings between the two walls.

* * * * *